US005304028A

United States Patent [19]

Rosenberger et al.

[11] Patent Number: 5,304,028

[45] Date of Patent: Apr. 19, 1994

[54] METHOD AND APPARATUS FOR THE DEJACKETING OF FLAT PARALLELIPIPEDIC DEEP-FROZEN BLOCKS PACKED IN ONE-PIECE FOLDING CARTONS

[75] Inventors: Jörg Rosenberger, Haltern-Flaesheim; Franz Book, Haltern, both of Fed. Rep. of Germany

[73] Assignee: Heinz Nienstedt Maschinenfabrik GmbH, Haltern, Fed. Rep. of Germany

[21] Appl. No.: 793,783

[22] Filed: Nov. 18, 1991

[30] Foreign Application Priority Data

Dec. 3, 1990 [DE] Fed. Rep. of Germany ..... 4038457

[51] Int. Cl.[5] ..... B65B 69/00

[52] U.S. Cl. ..... 414/412; 414/411; 414/786; 414/403; 83/946

[58] Field of Search ..... 414/411, 412, 403, 786; 83/109, 112, 134, 155, 161, 401, 425.2, 435.2, 946, 952

[56] References Cited

U.S. PATENT DOCUMENTS

| | | | |
|---|---|---|---|
| 3,457,642 | 7/1969 | Steer et al. | 83/946 X |
| 4,023,692 | 5/1977 | Ittner et al. . | |
| 5,090,573 | 2/1992 | Takahashi et al. | 414/412 X |

FOREIGN PATENT DOCUMENTS

| | | | |
|---|---|---|---|
| 673346 | 10/1963 | Canada | 83/946 |
| 240289 | 10/1987 | European Pat. Off. | 414/412 |
| 1403146 | 5/1965 | France | 414/412 |
| 39492 | 3/1977 | Japan | 414/412 |
| 90/03314 | 4/1990 | PCT Int'l Appl. | 414/412 |

*Primary Examiner*—Frank E. Werner

*Attorney, Agent, or Firm*—Meltzer, Lippe, Goldstein

[57] ABSTRACT

The invention relates to a method and apparatus for the dejacketing of flat, parallelipipedic blocks packed in folding cartons. Dejacketing is performed in three steps. First the flaps provided overlapping one another on opposite sides are unfolded by being moved past unfolding tools. The blocks are then moved past a further unfolding tool which is disposed on the third narrow side and which unfolds the flaps provided at that place. In the third step the folding carton is seized by its lower flap on the third side and pulled downwards, the block being simultaneously advanced in the direction of its open third side, and the top side is stripped off at a fixed stripper.

8 Claims, 4 Drawing Sheets

(B)

(A)

Figure 1:
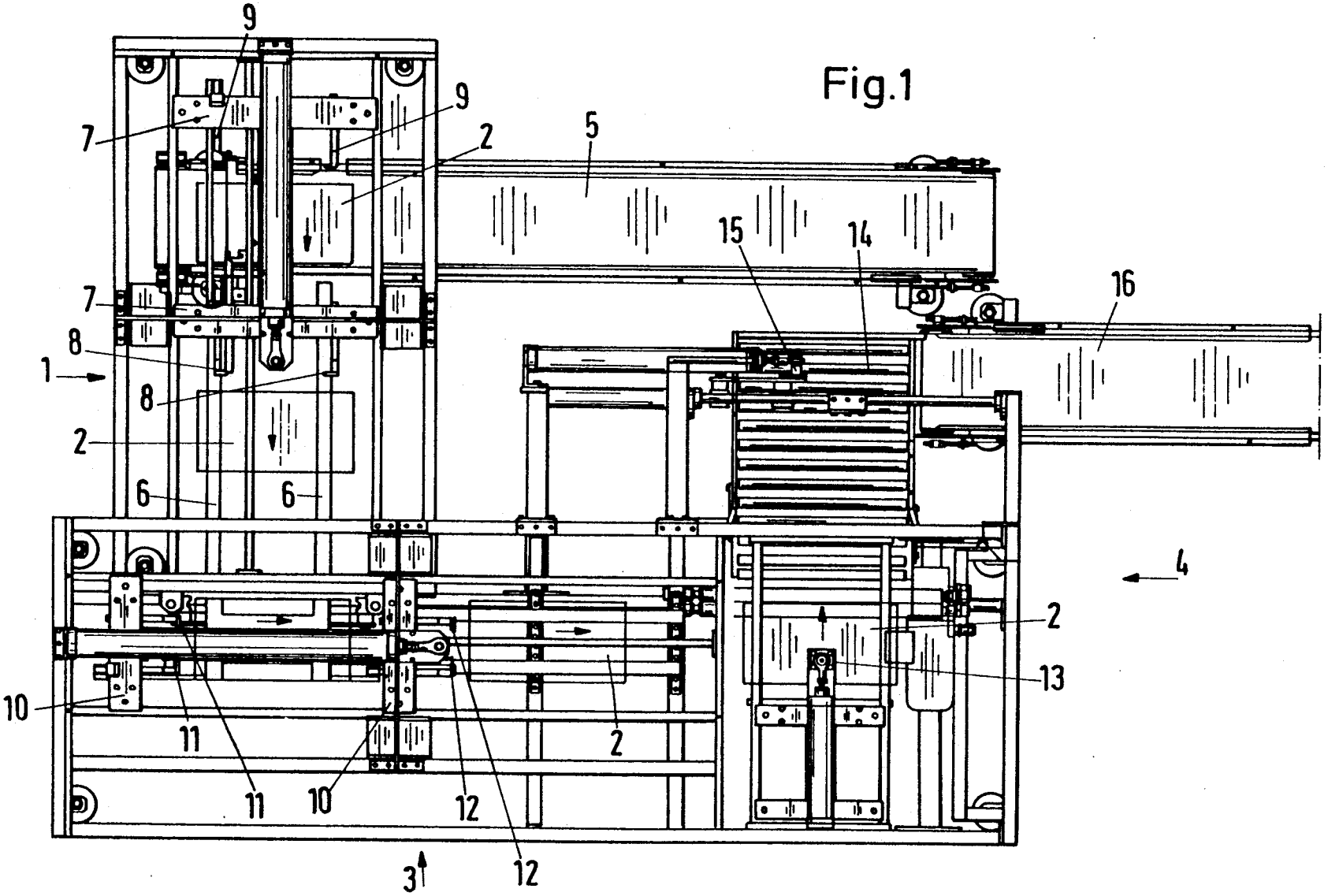

METHOD AND APPARATUS FOR THE DEJACKETING OF FLAT PARALLELIPIPEDIC DEEP-FROZEN BLOCKS PACKED IN ONE-PIECE FOLDING CARTONS

The foodstuffs industry makes available to the consumer deep-frozen foodstuffs, more particularly fish, in small portions ready for consumption. The foodstuffs industry receives the fish in the form of deep-frozen parallelipipedic blocks packed in folding cartons. Such blocks have dimensions in the order of magnitude of 70 mm×300 mm×500 mm. The blocks supplied packaged in this way to the foodstuffs industry are manually dejacketed for the preparation of portioning into smaller units, for example, fingers. During this process the folding carton is unfolded or torn open. The speed and completeness of dejacketing depends on the skill of the person performing these tasks. It is important that no residues of the carton material are left sticking to the deep-frozen blocks. Dejacketing deep-frozen blocks in this way is laborious, troublesome and expensive.

Such problems do not exist with other goods packaged in folding cartons, since the goods do not stick to the inside of the carton material. For this reason such folding cartons have been continuously opened mechanically for many years.

For example, in a prior art apparatus a parallelipipedic folding carton is opened on three sides as follows: the folding carton is moved over a linear conveying path past a fixed slitting tool and then moved over a second conveying path, disposed at an angle of 90° to the first conveying path, past two further slitting tools engaging at opposite sides. After these three sides have been slit open, the upper portion of the folding carton is hinged upwards like a lid (DE-OS 24 16 697). A folding carton containing deep-frozen blocks cannot be opened in that way, since the top part of the folding carton, which still encloses the upper zone of the block on all sides, sticks so tightly to the deep-frozen block that such portion cannot readily be lifted off by simple means. Another difficulty with folding cartons which close the blocks on three narrow sides by flaps overlapping one another but not glued to one another, is that when the flaps not glued to one another provided on the narrow sides are parted, the severed portions of the flaps must be manually collected to prevent them from interfering with mechanical handling during dejacketing. Lastly, another problem is that during slitting open the cutting tools are dirtied by carton material dirty on the outside, so that dirt is transferred to the foodstuff.

In another prior art apparatus a parallelipipedic carton is moved over two portions of a conveying path, two opposite sides being slit open over the first portion and the remaining opposite sides being slit open over the second portion, the result being a slit extending all around. To enable the carton to be slit open on the remaining sides following the first portion, the carton does not change its conveying direction by 90°, but is turned through 90°. That method also is unsuitable for the dejacketing of deep-frozen blocks, since the lateral portions of the top part stick to the deep-frozen blocks and impede the lifting-off of the top part.

It is an object of the invention to provide a method and apparatus for the mechanized dejacketing of blocks of deep-frozen foodstuffs.

The invention starts from a method for the dejacketing of flat parallelipipedic deep-frozen blocks, more particularly blocks of fish, which are packaged in one-piece folding cartons closed on three narrow sides by flaps overlapping one another, this problem being solved in the method according to the invention by the following successive steps:

a) the jacketed block is conveyed over a first linear path while at the same time being moved on opposite sides of the path past the two opposite unfolding tools acting after the fashion of ploughs which are associated with the narrow sides of the block closed by the straps and which are inserted between the block and the flaps, b) after the conveying direction of the block has been changed by 90°, the jacketed block is conveyed over a second linear path while at the same time it is moved by its third narrow side, still closed by the flaps, past a folding tool acting after the fashion of a plough which is disposed laterally of the path and is introduced between the block and the flaps, c) at the end of the second path the folding carton is seized by the lower flap of the third narrow side and pulled downwards, after the conveying direction of the block has again been changed by 90°, with the opened third narrow side leading in the conveying direction, accompanied by the conveying of the block and the stripping of the top side of the folding carton.

If a folding carton is used in which the flaps have corner flaps engaging around the corners of the carton, the corner flaps are cut off by cutting edges provided on the unfolding tools before and after the unfolding of the flaps. In the method according to the invention the carton material is not cut open, but the folding carton is prepared in two steps for the actual dejacketing operation, by the straps being unfolded on the three narrow sides. The still adhering underside and top side can then readily be peeled off the block thus prepared, the underside being pulled away downwards at the same time as the block is conveyed, and the top side being stripped off. It has been found that this kind of dejacketing makes it unnecessary to subject the jacketed block to a special heat treatment to slightly thaw the block of fish in the boundary layer between the carton material and the block, so as to reduce the adhesion of the carton material. Since the folding carton is not parted, it is moreover removed by this step from the actual zone of operation of the dejacketing station. Since the block is covered by the folding carton on its top and bottom sides and also the narrow rear side over the whole conveying path up to dejacketing, the block is substantially protected against dirtying by the conveying means.

This problem is solved in the apparatus according to the invention by at least two conveying means, disposed one after the other for the linear conveying of the jacketed blocks lying flat in conveying means offset by 90° in relation to one another, and a dejacketing station disposed at the end of the second conveying means, while unfolding tools acting after the fashion of ploughs which can be introduced between the flaps and the narrow sides of the block are associated with the first conveying means on opposite sides of the conveying path and with the second conveying means on one side of the conveying path, and the dejacketing station is adapted for changing the conveying direction of the block by 90° and has downwardly pulling elements acting on the lower flap of the third narrow side and also a stripping element acting on the top side of the folding carton.

To ensure the precise introduction of the unfolding tools between the flaps and the block, according to one feature of the invention the unfolding tools are spring-loaded in the direction of the narrow side of the block and guided by feelers bearing against the narrow sides. In a corresponding manner also the stripping element can be spring-loaded in the direction of the upper wide side of the block and spring-loaded by a feeler bearing against the upper wide side.

The pulling-off elements are preferably a pair of driven clamping rollers. To facilitate the introduction of the flap between the clamping rollers, one clamping roller should be adjustable. The introduction of the flaps between the clamping rollers and/or the transfer of the flap to the stripping element can be further improved by the feature that guide elements for the flaps are provided between the unfolding tool for the flaps on the third narrow side and the pulling-off elements and/or the stripper.

Dejacketing can also be facilitated if the dejacketing station has a pusher which advances the blocks in dependence on the drive of the pulling-off elements.

Figure 2:
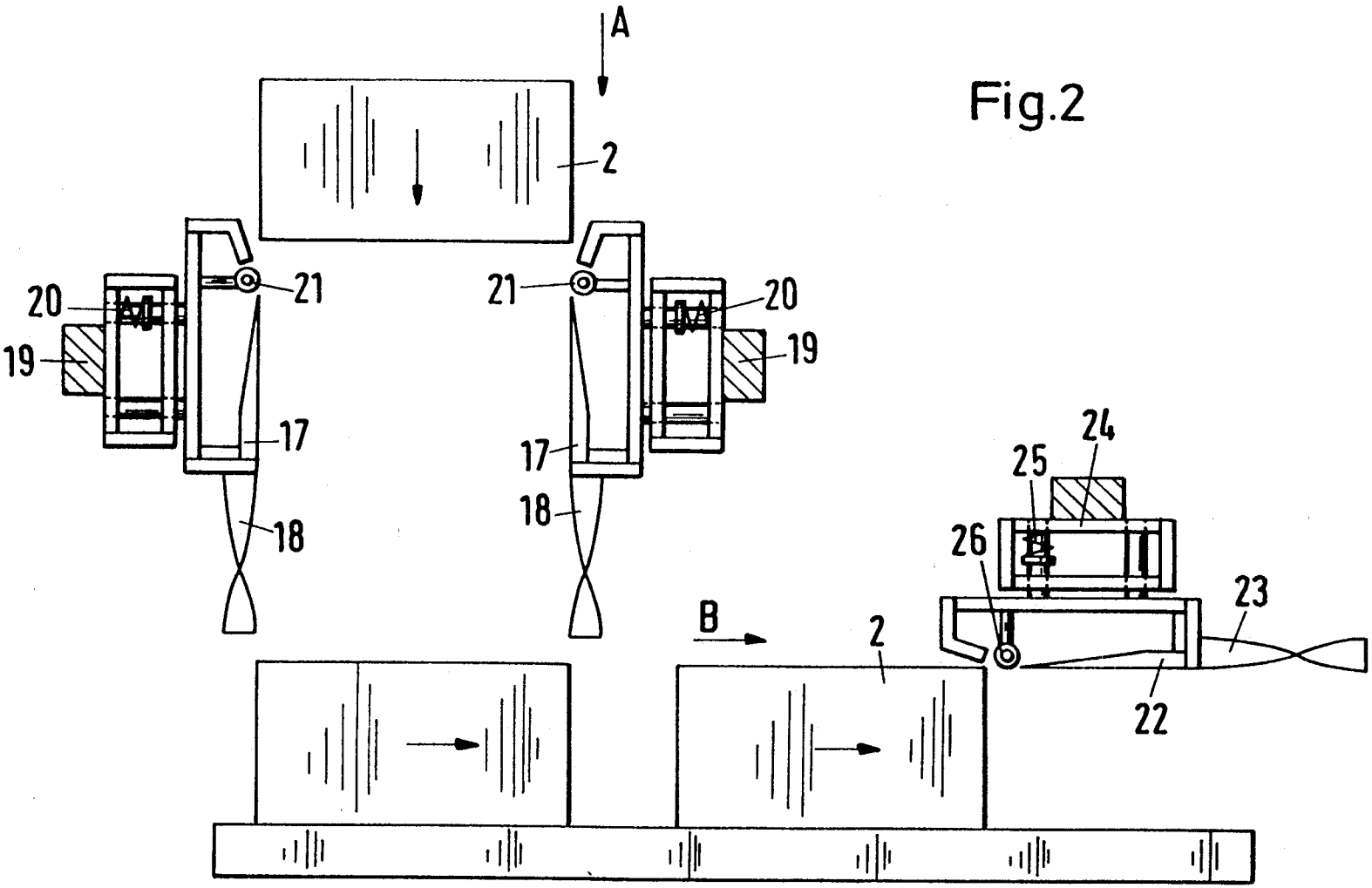
Figure 4:
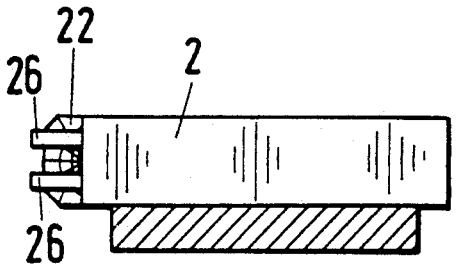
Figure 3:
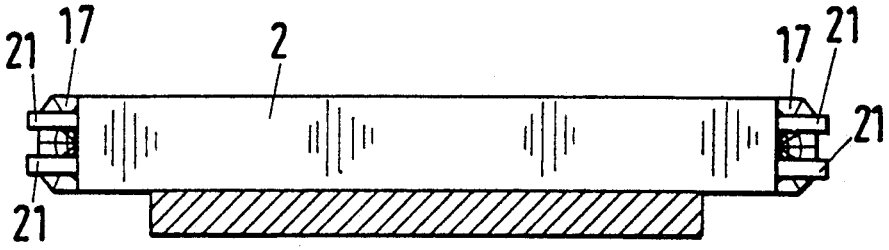
Figure 5:
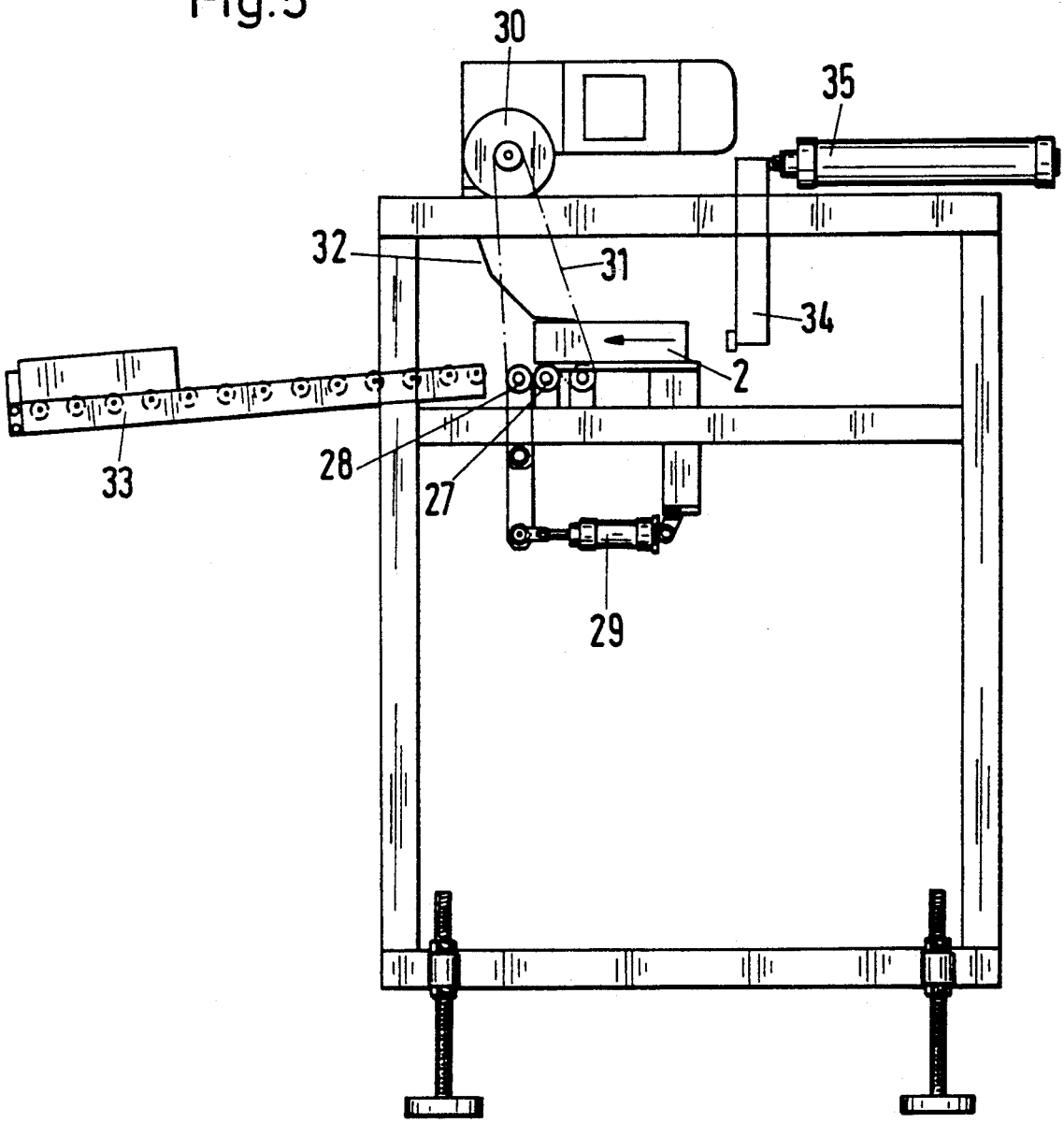

The invention will now be explained in greater detail with reference to drawings which illustrate an embodiment of a dejacketing apparatus for parallelipipedic blocks packaged in folding cartons and wherein:

FIG. 1 is a plan view of the dejacketing apparatus,

FIG. 2 is a diagrammatic plan view of a detail of the dejacketing apparatus illustrated in FIG. 1, showing unfolding tools, FIG. 3 is an elevation of the unfolding tools illustrated in FIG. 2, taken from the direction of the arrow A in FIG. 2, FIG. 4 is an elevation of the unfolding tools illustrated in FIG. 2, taken from the direction of the arrow B in FIG. 2, and FIG. 5 shows the dejacketing device illustrated in FIG. 1 diagrammatically, sectioned along the line I—I in FIG. 1.

Referring to FIG. 1, a dejacketing apparatus comprises a first conveying means 1 for the linear conveying of parallelipipedic blocks 2 lying flat, a second conveying means 3 for conveying the blocks 2 lying flat offset by 90° in relation to the first conveying means, and a dejacketing station 4.

The first conveying means 1 is preceded by a belt conveyor 5 on which the blocks 2 to be dejacketed are so laid flat manually that the overlapping flaps of the opposite narrow sides lie forward and rearward in the conveying direction and on the long side shown at the top in the drawing. The belt conveyor 5 conveys the blocks 2 with a short narrow side leading to the conveying means 1. In the conveying means 1 the blocks are advanced on rails 6 with the flap-free closed long narrow side leading. They are advanced by a horizontally reciprocable carriage which is disposed above the conveying plane and is equipped with two sets of entraining means 8, 9 which can be raised and lowered and during advance engage with the rear edge of the block 2. The drawing shows the carriage 7 in the retracted position. By means of the carriage 7 the blocks 2 are advanced to the conveying means 3.

The conveying means 3 has a corresponding carriage 10 having two sets of entraining means 11, 12 by which the blocks 2 are conveyed as far as the dejacketing station 4.

The dejacketing station 4 has a tappet 13 which seizes the blocks 2 by the flap-free closed narrow side, now at the rear in the conveying direction, and advances the blocks in the direction of a roller train 14 from whose end the dejacketed blocks 2 are pushed by a pusher 15 on to a belt conveyor 16.

In the zone between the belt conveyor 5 and the conveying means 3, the conveying means 1 has unfolding tools on the two sides associated with the short narrow sides of the block 2. As shown by FIG. 2, the unfolding tools each comprises an unfolding blade 17, which can be introduced at the end between the overlapping flaps and the narrow side of the block 2, possibly accompanied by the parting of a corner flap retained on the flaps and engaging around the corner of the block 2, and adjoining unfolding guides 18 for the top and bottom straps. The blade 17 has in cross-section substantially the shape of the segment of a circle with cross-section increasing in the conveying direction of the block 2, so that the blade initiates the operation of unfolding the flaps. The unfolding guides 18 complete the unfolding operation.

So that the unfolding blade 17 can enter precisely between the flaps and the narrow side of the block 2, the blade is retained in a guide 19 together with unfolding guides 18 and stressed by a spring 20 in the direction of the narrow sides. The blade is adjusted by a feeler roller 21 to the position of the narrow side of the block 2.

The unfolding tool of the conveying means 3 is disposed between the place of transfer between the conveying means 2 and 3 and the dejacketing station 4 on that side of the conveying path with which the long narrow side with the flaps is associated. Its construction therefore corresponds to that of the unfolding tools described. It therefore comprises an unfolding blade 22, top and bottom unfolding guides 23, a guide 24, a spring 25 and a feeler roller 26. The block 2 therefore leaves the conveying means 3 with unfolded flaps on the two opposite short narrow sides and with unfolded flaps on the long narrow side.

The dejacketing station shown in FIG. 5 has two clamping rollers 27, 28 which are disposed below the conveying plane and of which the clamping roller 28 can be adjusted by means of an adjusting cylinder 29. The clamping rollers 27, 28 are driven by a motor 30 via a belt 31. Disposed above the clamping rollers 27, 28 in the conveying direction is a stationary stripper 32 in the form of a metal plate which, like the unfolding tools described, can be vertically adjusted to the top side of the blocks 2. A pusher 34 driven by a cylinder piston drive 35 advances the block 2 to be dejacketed in the direction of a following roller train 33.

The transfer of the block 2 opened on its long narrow side from the preceding conveying means 3 to the dejacketing station is so performed with the clamping rollers 27, 28 opened that the unfolding guide 23 introduces the bottom strap between the clamping rollers 27, 28 and the top flap behind the stripper 32, as shown in FIG. 5. As soon as the driven clamping rollers 27, 28 seize the flap and the block 2 is advanced by the pusher 34, the underside of the folding carton is pulled downwards and the top side of the folding carton is pushed on to the stripper 32 until the rear edge of the block 2 reaches the clamping rollers 27, 28. As the block 2 continues to be conveyed, the rear narrow side and the top side with the flaps of the folding carton are pulled downwards by the clamping rollers 27, 28, thus completing the dejacketing operation.

We claim:

1. A method for dejacketing a parallelipipedic deep-frozen block which is packed in a one-piece folding carton, said carton having overlapping flaps on first, second, and third narrow sides, said first and second narrow sides being opposite to each other, said method comprising:

conveying said block along a first linear direction, while said block is being conveyed along said first linear direction, unfolding said overlapping flaps on said first and second narrow sides by inserting unfolding tools between said overlapping flaps on said first and second narrow sides and said block, conveying said block along a second linear direction which is at a right angle to said first linear direction, while said block is being conveyed along said second linear direction, unfolding said overlapping flaps on said third narrow side by inserting an unfolding tool between said overlapping flaps on said third narrow side and said block, conveying said block along a third linear path which is at a right angle to said second linear path, while said block is being conveyed along said third linear path, seizing a lower flap of said third narrow side and pulling it downward and stripping an upper flap of said third narrow side thereby removing said one-piece folding carton from said block.

2. The method of claim 1 wherein said one-piece folding carton includes corner flaps engaging around corners of said carton, said method further comprising slitting said corner flaps on said first, second, and third narrow sides.

3. An apparatus for dejacketing a parallelipipadic deep-frozen block which is packed in a one-piece folding carton, said carton having overlapping flaps on first, second, and third narrow sides, said first and second narrow sides being opposite each other, said apparatus comprising first conveying means for conveying said block along a first direction, first and second unfolding means which are inserted between said overlapping flaps on said first and second narrow sides and said block for unfolding said overlapping flaps on said first and second narrow sides as said block is conveyed along said first direction, second conveying means for conveying said block along a second direction which is at a right angle to said first direction, a third unfolding means which is inserted between said overlapping flaps on said third narrow side and said block for unfolding said overlapping flaps on said third narrow side as said block is conveyed along said second direction, and a dejacketing station including means for conveying said block along a third direction which is a right angle to said second direction, means for pulling a lower flap of said third narrow side downwardly, and means for stripping upwardly an upper flap of said third narrow side, thereby removing said one-piece folding carton as said block is conveyed along said third direction.

4. The apparatus of claim 3 wherein said first, second, and third unfolding tools are spring-loaded towards said first, second, and third narrow sides of said block, and said apparatus includes feelers bearing against said first, second, and third narrow sides to aid in inserting said unfolding means between said overlapping flaps and said block.

5. The apparatus of claim 3 wherein said stripping means is spring-loaded towards an upper wide side of said block, and said apparatus includes a feeler bearing against said upper wide side to aid in stripping said upper flap from said third narrow side.

6. The apparatus of claim 3 wherein said pulling means comprises driven clamping rollers.

7. The apparatus of claim 6 wherein one of said clamping rollers is adjustable.

8. The apparatus of claim 3 wherein said dejacketing station includes a pusher which advances said block along said third direction.

* * * * *